United States Patent [19]

Lemelson

[11] 4,226,356

[45] Oct. 7, 1980

[54] CONTAINER AND DISPENSER STRAW

[76] Inventor: Jerome H. Lemelson, 85 Rector St., Metuchen, N.J. 08840

[21] Appl. No.: 830,064

[22] Filed: Sep. 2, 1977

[51] Int. Cl.[3] ..... B65D 1/08; B65D 3/00; B65D 5/00

[52] U.S. Cl. ..... 229/7 S; 220/90.2; 215/1 A

[58] Field of Search ..... 229/7 S; 215/1 A; 220/90.2

[56] References Cited

U.S. PATENT DOCUMENTS

| | | | |
|---|---|---|---|
| 3,362,607 | 1/1968 | Weitzman | 229/7 S |
| 3,559,868 | 2/1971 | Chang | 229/7 S |
| 3,656,654 | 4/1972 | Brinkley | 229/7 S |
| 3,717,476 | 2/1973 | Harvey | 229/7 S |
| 3,946,895 | 3/1976 | Pugh | 229/7 S |

*Primary Examiner*—George T. Hall

[57] ABSTRACT

A liquid container such as a metal or plastic cannister or can having a drinking straw disposed therein which straw becomes available for drinking the liquid contents of the container when the container is opened. In one form, the container top wall is provided with a finger pulled tab secured to or extending from a removable portion of the top wall and, when pulled, the tab not only provides an opening in the top wall but exposes or pulls out of the container the upper portion of a drinking straw. In a preferred embodiment, the straw is a plastic or impregnated paper tube containing a pleated or bendable portion thereof and the upper portion of the straw is deformed either downwardly along the remaining body of the straw or conforms to that portion of the container top wall which is removed so that, upon removal of the removable portion, the upper portion of the straw will be pulled thereby through the opening so that it may be engaged by mouth and used. The lower portion of the straw may be secured or frictionally held against the side or bottom wall of the container to maintain it in place.

10 Claims, 8 Drawing Figures

CONTAINER AND DISPENSER STRAW

SUMMARY OF THE INVENTION

This invention relates to a container for liquid containing disposed therein a drinking straw which becomes available to permit the person opening the container to drink the liquid contents thereof. In a preferred embodiment, the straw is disposed along a side wall of the container and held in position in direct alignment with a portion of the top wall which is removed or moved when the container is opened to provide an opening in the top wall through which the drinking straw is caused to protrude to permit the liquid contents of the container to be drawn through the straw by mouth. The upper end of the straw may be temporarily secured to the removed or moved portion of the container top wall so that when it is moved or removed with respect to the top wall, the upper end of the straw will be pulled through the opening so formed in the top wall.

Various proposals have been made for providing tubes or drinking straws in containers, such as metal cans containing carbonated and non-carbonated drinks, to provide means for drawing the contents of the container into the mouth of a person desiring to drink same without the necessity of upending the container and contacting the wall or walls of the container with the lips and mouth. These proposals have not heretofore been commercially successful for a number of reasons including the fact that a conventional drinking straw disposed in such a container can be no longer than the length of the container and, as a result, when the upper end of the straw floats upwardly through the opening in the container when the closure is removed or partially removed, the lower end of the straw cannot provide access to within more than about an inch of the bottom of the container as at least a similar amount is required to protrude from the upper end of the container to permit it to be placed between the lips of the person drinking the contents.

Accordingly, it is a primary object of this invention to provide a new and improved container assembly including a drinking straw disposed within a container for use when the container is opened in drinking the contents thereof.

Another object is to provide a container containing a liquid and a drinking straw provided within the container for drinking the liquid thereof which straw is exposed and partially removed from the container when the container is opened.

Another object is to provide a container and a straw located therein which is attached to a portion of the container wall which portion is moved or removed for removal of the contents of the container and, in being so moved, serves to pull the upper end of the straw through the opening provided therein.

Another object is to provide a container or a quantity of liquid and a straw located within the container which straw is deflected or bent within the container to provide it the length which is greater than the length of the container such that, when a portion of the straw is removed from the container for drinking purposes, the other end of the straw may be disposed immediately adjacent the bottom wall of the container so that all of the contents of the container may be easily removed therefrom by means of the straw.

Another object is to provide a container with a straw assembled and supported therein to retain it in position in alignment with an opening in the container wall wherein the straw, after the opening is effected, may project through the opening to permit access to its upper or exposed end for drinking purposes.

Another object is to provide a container for an individual portion of a liquid to be consumed by drinking, wherein a drinking straw or tube is affixed within the container in alignment with an opening in the upper end of the container provided when a closure is removed therefrom such that the upper end of the straw or tube is accessible for drinking therethrough.

Another object is to provide a new and improved packaging arrangement wherein a drinking straw is disposed within a container such as a metal can, plastic or glass bottle, wherein the straw is greater in length than the length of the container but is in a deformed or bent condition such that, when an opening is provided in the container adjacent the straw, the deformed portion thereof will self deflect through the opening making it accessible for drinking purposes.

With the above and such other objects in view as may hereinafter more fully appear, the invention consists of the novel constructions, combinations and arrangements of parts as will be more fully described and illustrated in the accompanying drawings but it is to be understood that changes, variations and modifications may be resorted to which fall within the scope of the invention as claimed.

Figure 1:
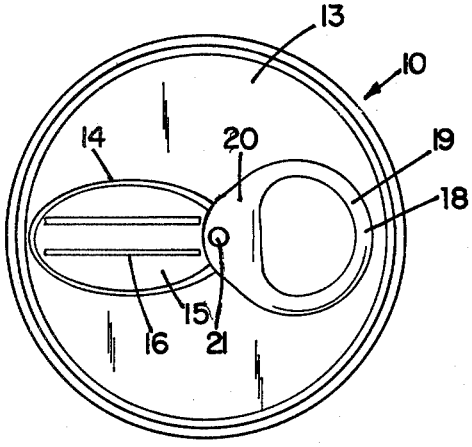
FIG. 1 is a top view of a container having a top wall made of metal and a pull tab tear opening means for providing an opening in the top wall when pulled.
Figure 2:
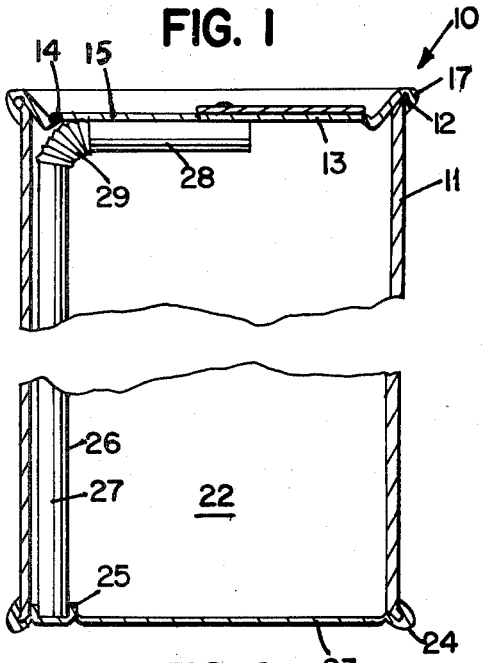
FIG. 2 is a side view of fragmentary portions of the container of FIG. 1 with parts broken away for clarity showing a drinking straw retained within the unopened container.
Figure 3:
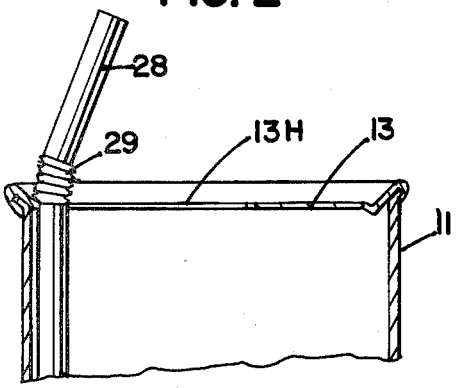
FIG. 3 is a fragmentary view of the container of FIGS. 1 and 2 showing the upper end of the straw of FIG. 2 protruding through an opening provided in the top wall of the container.

In FIGS. 1 to 3 is shown a container assembly 10 in the form of a canister or can having a cylindrical side wall 11, preferably made of a metal such as aluminum or steel, although it may also be made of plastic, coated or impregnated paper, paperboard or laminates of paperboard and aluminum foil. Secured to the upper end of side wall 11 is a top wall 13 and secured to the bottom end thereof is a bottom wall 23. Walls 13 and 23 are respectively secured to side wall 11 by beading 17 which is formed around and composed in part of the upper rim 12 of the side wall and beading 24 formed with the lower rim thereof. Bottom wall 23 may also be formed of the same material of which the side wall is formed and molded or stamped as an integral formation thereof.

Top wall 13 contains an elongated portion 15 which is defined within a score line 14 and which contains secured to one end thereof a ring-shaped tab-like removal device 18 having a ring-like portion 19 and an end portion 20 which is secured by means of a rivet 21 to the end of the portion 16 of the upper wall 13. When the ring portion 19 is pulled upwardly to the left, shearing of the portion 15 is effected along the score line 14 and an opening 13H is provided in the top wall 13 as shown in FIG. 3.

In FIG. 2, a drinking straw 26 is shown having a lower portion 27 extending substantially the length of the container 10 and an upper portion 28 joined to the lower portion by means of a pleated or accordion-like portion 29 permitting the upper portion 28 to be deflected and extend laterally outwardly from the lower portion 27 as shown, without collapsing at the joining portion 29. Portion 28 is aligned with and does not extend beyond the end of the removable portion 15. It may merely rest against portion 15 and be centered thereagainst by means of parallel rib-like formations 16 formed in portion 15 and projecting downwardly therefrom. Straw portion 28 may also be removably attached to cover or top wall portion 15 by means of an adhesive or one or more deformed portions of the removable portion 15 as illustrated in FIGS. 4–8.

When the pull tab 18 is pulled and the top wall portion 15 is removed as described, either the memory of the plastic forming the tubular straw 26 which tends to return portion 28 to somewhat near its pre-deformed shape, as shown in FIG. 3, or the retention of portion 28 against the portion 15 serves to cause the straw portion 28 to self-deform or be pulled upwardly through the opening 13H by the upward movement of the top wall portion 15 as it is pulled upwardly and away from the top wall as illustrated, for example, in FIG. 3.

If the upper portion 28 of the straw 26 is retained in the position illustrated in FIG. 2 against the bottom surface of the central portion of the removable portion 15 of the top wall by virtue of the bottom end of the lower portion of the straw being compressed against the bottom wall 23 or by means of adhesive bonding or mechanical gripping of the upper end 28 of the straw, then it will not be necessary to maintain the lower and major portion 26 of the straw in position within the container volume 22 by an auxiliary means. Compressing the straw as shown in FIG. 2 between the top and bottom walls may suffice to retain it in position whereby the upper portion 28 remains aligned with the movable portion 15 of the can top wall. However, if necessary, an auxiliary means may be employed to retain the lower portion 27 of the drinking straw in a fixed location within the volume 23 and such auxiliary means may comprise a dimple-like formation 25 in the bottom wall 23 which protrudes either into the interior of the lower end of the straw or engages the exterior wall thereof.

A number of variations are provided in FIGS. 4–8 in the shape of the drinking straw and means for frictionally securing it to the portion of the top wall or lid of the container so that it will be pulled upwardly through the opening provided in the top wall when the movable portion thereof is pulled upwardly and severed from the top wall.

Figure 4:
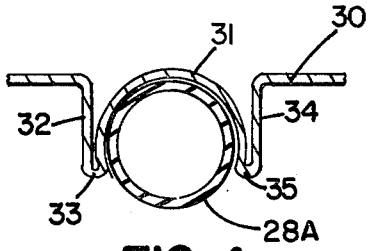
FIG. 4 is a fragmentary view in cross section of the top wall of a container of the type shown in FIGS. 1–3 showing a retaining means for the horizontally extending upper end of the straw of FIG. 2.

In FIG. 4, the top wall movable portion is denoted 30 and contains a central portion 31 of semi-cylindrical shape conforming to slightly more than half the cylindrical surface of the upper portion 28A of the drinking straw. The portion 31 is defined by U-shaped side portions 32 and 34 the ends or extremities 33 and 35 of which frictionally engage the side wall of the upper portion 28A of the straw in a manner such that when the entire portion 30 is severed from the top wall 13 and pulled upwardly therefrom, it will pull the upper portion 28 through the opening so formed in the top wall yet will itself be separated from the straw as it is removed from the top wall of the container.

Figure 5:
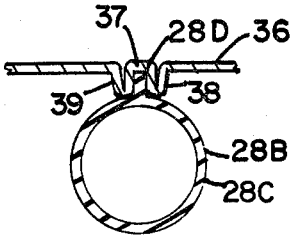
FIG. 5 is a fragmentary view in cross section of the top wall of a container showing another means for temporarily holding a straw in assembly therewith prior to opening the container.

In FIG. 5 the upper portion 28B of the drinking straw contains a lip 28D formed integral with its side wall 28C which lip or protrusion is frictionally engaged within the side walls of a U-shaped deformation 37 formed in the removable portion 36 of the container top wall. Notations 38 and 39 refer to respective U-shaped formations of the removable portion 36 on both sides of the U-shaped formation 37.

Figure 6:
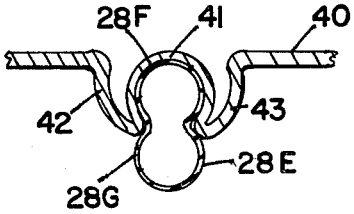
FIG. 6 is a fragmentary view in cross section of the top wall of a container showing yet another means for holding the top portion of a drinking straw in temporary assembly therewith.

In FIG. 6, the upper portion 28E of the drinking straw is formed of parallel tubular formations 28G and 28F each of which is more than half a cylinder but both of which are interconnected as shown. The inward formation 28F is shown frictionally gripped between a U-shaped formation 41 of the removable portion 40 of the container top wall while side U-shaped formations 42 and 43 join formation 41. Frictional retention is such that when the portion 40 is removed or upwardly deflected during opening the can, the upper portion 28E of the straw will be removed through the opening and will be separated from U-shaped formation 41 as the portion 41 is further deformed or removed from the can.

Figure 7:
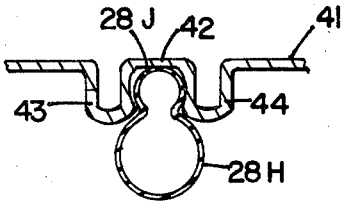
FIGS. 7 and 8 are both fragmentary view in cross section of container top walls showing different means for holding drinking straw in assembly therewith.

FIG. 7 is somewhat similar to FIG. 6 having the upper portion of the straw formed with a large cylindrical portion 28H and a smaller cylindrical portion 28J which is frictionally gripped by the central U-shaped formation 42 of the removable portion 41 of the container top wall. U-shaped portions 43 and 44 join portion 42 to the remainder of the top wall 41.

Figure 8:
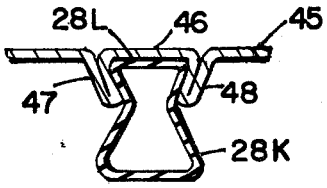

In FIG. 8, the upper portion 28K of the straw is formed, as shown, with tapered side walls which taper toward a smaller diameter from one side of the straw to the other providing an outwardly tapering portion 28L which is gripped by the side walls of a U-shaped portion 46 of the removable portion 45 of the can top wall. Here again, when portion 45 is moved or deflected upwardly, the upper portion 28J of the straw is only frictionally held by the side walls 47 and 48 of U-shaped portion 46 permitting the straw to remove itself therefrom when portion 45 of the top wall is removed from the top wall.

In modified forms of the invention, it is noted that the top wall may be molded of plastic and frictional or lateral retention of the upper portion of the straw may be effected by molded ribs or ridges formed in the bottom surface of the top wall of the container. A preferable arrangement in all of the embodiments illustrated is to merely retain the upper portion of the straw within the channel formed of the ridge or ribs extending downwardly from the removable portion of the container top wall or to deform a portion of the removable portion to engage in the open end of the upper portion 28 of the straw so that when the tab is pulled and the removable portion of the top wall is pulled upwardly, the upper portion of the straw will easily and quickly release therefrom after it has been pulled through the opening or will deform as a result of its own memory up through the opening when the portion of the top wall extending across the opening is deflected or severed from the top wall.

In yet another embodiment, severed portion of the top wall of the container need not be completely removed from the container but may remain attached thereto as a result of providing the score line only partially around the portions 15, 30, 36, 40, 41 and 45 of the top wall so that when the tab is pulled, such portions will remain attached.

In yet another embodiment, if the container is made of paper or paper board, the deflected portion of the straw may be adhesively bonded to the removable or tab-like portion of the wall in which the opening is provided so as to pull the deflected portion of the straw through the opening when the tab is removed or partially severed and deflected from the wall of which it is formed.

In still another embodiment, it is noted that the removable portion of the top wall of the container may comprise a separately formed tab or cover which is shaped or contains adhesive to temporarily retain the deflectable portion of the straw thereagainst and to pull same through the opening provided when such cover or tab is removed or partially removed from the wall of the container to which it is attached. Attachment to the container wall may also be effected by means of an adhesive, by heat sealing or mechanical means.

Additional variations in the invention are noted as follows:

I. If the container top wall is provided with an opening therein such as a circular cutout or molded hole, the container may be closed after filling with a liquid such as a non-carbonated drink, by means of a patch or section of a thin foil or plastic film which is coated on its inside surface with a suitable pressure sensitive adhesive to adhesively retain such closure in assembly with the top wall of the container across the opening. That portion of the adhesive coating the plastic or metal film which extends across the opening may engage and hold the upper portion of the drinking straw (portion 28 in FIG. 2) in place as shown. Theclosure may contain an unbonded tab portion which, when pulled upwardly by hand, removes the closure from the top wall and pulls the upper portion of the straw in a pivoting movement about the bent or deformed portion 29, upwardly through the opening so provided in the top wall to a position as illustrated, for example, in FIG. 3.

II. If the closure for the opening in the end or top wall of the container is a metal stamping or injection molding which snaps in place or screws onto a neck portion of the container surrounding an opening therein, the upper portion 28 of the straw may be deformed about the deformable serrated portion downwardly along the main body of the straw so that when the upper end of the straw floats or is drawn upwardly through the opening in the container by the fingers of the hand or by movement of the closure in an upward direction, the upper portion 28 will deflect or may be made to deflect and pivot to a position such as shown in FIG. 3 so that it may be placed between the lips of a person wishing to drink the container's contents through said straw, III. The container may also be molded or extruded with a tubular formation formed integral on the inside surface of the side wall of the container and extending to near the bottom end thereof to serve as the lower portion or main body of the drinking straw or tube. The upper portion of the drinking straw corresponding to portion 28 may have a serrated or pleated side wall at its lower end, such as shown at 29 and the lower end thereof may be welded or otherwise fastened to the upper end of the tubular formation which is extruded or molded integral as part of the side wall of the container. The remaining construction of the container including the means for providing an opening in the top wall thereof to effect or permit such upper end of the straw assembly to deform upwardly in pivotal type movement through the opening in the top wall so provided.

IV. If the upper end portion 28 of the straw 26 of FIG. 2 is deformed 180° back against the main body of the straw it may be frictionally held against or within the side wall of a bottle closure or cap of conventional design or specially constructed to so hold the end thereof such that, when the cap or closure is removed from the bottle as by unscrewing same or prying same off, the upper end of the straw will be drawn by the cap out of the upper end of the bottle. Thereafter the deformed portion of the straw may be pivoted by hand or naturally deform in returning to its predeformed position to permit it to assume the position shown in FIG. 3 for drinking therewith.

Further modifications to the container assemblies described are noted as follows:

If the container is a paperboard container, such as a milk carton having a folded closure means such as portions of its side walls engaged together and folded inwardly to close the container, the bent upper end portion of the drinking straw may be disposed within or immediately below the folded portion of the container so as to be exposed to the exterior of the container when the closure is unfolded and opened. Upon opening the container, the straw will either float upwardly in the liquid therein and extend through the opening or may be grasped between the forefinger and the thumb of the hand and lifted through the opening whereby it may be deflected about the deformable portion thereof to an extended position whereby a portion of the straw will project from the upper end of the container for drinking purposes while the other end thereof will extend to near the bottom of the container.

If the container of liquid to be consumed by mouth is a flexible bag, it may be provided with a pull tab opening means and a plastic tube or straw of the type described having its upper end sealed or otherwise secured to the pull tab opening device in a manner such that it will be pulled out of the opening in the container wall when the tab is pulled yet may easily be peeled or removed from the inside surface of the tab to permit it to be placed in the mouth of a person desiring to drink the contents of the bag container.

I claim:

1. A container and dispenser for a liquid held by said container comprising:

a closed container having a circumscribing side wall, a bottom wall connected to said side wall and a top wall secured to the upper end of side wall and serving to seal liquid contents within said container, a drinking straw disposed within said container and having an upper end portion connected to a lower portion by a bendable portion which may be bent without collapsing the wall of said straw, tab means integral with said top wall and removable therefrom, said tab means having at least one longitudinal formation retentively engaging a portion of the length of the upper end of said straw in a manner to permit said straw to be separated from said tab means by a manual pulling force applied between the end of said straw and said tab means, said upper portion of said straw extending in said container at an angle to said lower portion by virtue of the bending of said bendable portion within said container, means for opening said container by pulling said tab means to provide an opening in said top wall, which opening is in line with said straw, wherein said upper portion of said straw is pulled upwardly and passes through said opening and is accessible to the exterior of said container to permit a person holding said container to drink the contents of said container through said straw.

2. A container in accordance with claim 1 including means for retaining the lower portion of said straw substantially fixed within said container.

3. A container in accordance with claim 1 wherein said tab means is adapted to be pulled and severed from said top wall to form said opening in said top wall.

4. A container in accordance with claim 3 wherein said means for retentively engaging the upper portion of the straw to said tab means is frictional means permitting said upper portion of said straw to be removed from said tab means after it has been pulled through the opening in said top wall of said container.

5. A container in accordance with claim 4 wherein said tab means is formed of the material of the top wall of said container and the upper portion of said straw is frictionally retained in assembly with said tab means within said container.

6. A container in accordance with claim 5 wherein said top wall of said container is formed of sheet metal, such as aluminum, and said tab means is formed of an assembly of a ring-shaped portion connected to a portion of the top wall of said container located inwardly of a circumscribing score line which defines a portion of the top wall of said container which is removed when said ring-shaped portion is pulled, said tab means being longitudinally deformed so as to frictionally retain the upper portion of said straw thereagainst.

7. A container in accordance with claim 1 including means for retaining said lower portion of said straw within said container comprising a shaped portion of the bottom wall of said container engaging and holding the lower end of said straw in place thereagainst when the upper portion of the straw is retained by said tab means.

8. A container in accordance with claim 1 including a shaped portion formed in the wall of said straw frictionally secured to said longitudinally formed portion of said tab means.

9. A container in accordance with claim 1 wherein said container top wall has an opening therein and said tab means comprises a strip of flexible sheet material adhesively bonded to the top wall of said container across said opening therein, said upper end portion of said drinking straw being longitudinally bonded to said strip of flexible sheet material along its length for retaining said straw in place thereagainst and for causing the upper end portion of said straw to be drawn upwardly by said tab means through said opening in said container top wall when said flexible sheet material is peeled away from its position covering said opening.

10. A container in accordance with claim 1 wherein said tab means is shaped with a longitudinal indentation therein and a portion of the upper end portion of said straw is frictionally secured within said longitudinal indentation formed in said tab means to permit said upper portion of said straw to be pulled through the opening in said container provided when said tab means is pulled upwardly and away from the top wall of the container.

* * * * *